United States Patent [19]

Weinerman

[11] Patent Number: 4,511,166

[45] Date of Patent: Apr. 16, 1985

[54] HANDLE-OPERATED DOOR LOCK WITH LATCH-OPERATOR OVERRIDE

[75] Inventor: Lee S. Weinerman, Medina, Ohio

[73] Assignee: The Eastern Company, Strongsville, Ohio

[21] Appl. No.: 457,918

[22] Filed: Jan. 14, 1983

Related U.S. Application Data

[63] Continuation-in-part of Ser. No. 182,690, Aug. 29, 1980, abandoned.

[51] Int. Cl.[3] ..... E05C 3/30

[52] U.S. Cl. ..... 292/29; 292/106

[58] Field of Search ..... 292/1, 31, 107, 336.3, 292/27, 29, 49, 52, 124, 126, DIG. 26, 106

[56] References Cited

U.S. PATENT DOCUMENTS

| | | | |
|---|---|---|---|
| 348,656 | 9/1886 | Briggs | 292/169.22 |
| 1,331,166 | 2/1920 | Ochsner | 292/DIG. 26 |
| 1,987,927 | 1/1935 | Driessens et al. | 292/164 |
| 2,435,238 | 2/1948 | Schlage | 292/DIG. 26 |
| 2,530,330 | 11/1950 | Groeger | 292/29 |
| 2,540,686 | 2/1951 | Millburn | 292/124 |
| 4,126,340 | 11/1978 | Pelcin | 292/1 |

*Primary Examiner*—Richard E. Moore
*Attorney, Agent, or Firm*—David A. Burge

[57] ABSTRACT

A handle-operated lock for use on a sliding door has hook-shaped, rotary latch bolts which project from opposite sides of a housing for selectively engaging spaced strikes to selectively retain the sliding door in open or closed positions. A compression coil spring is carried within the housing for biasing the latch bolts toward their latched positions. Inside and outside rotary handles are provided for selectively rotating the latch bolts to unlatch them in opposition to the action of the spring. Inner and outer rotary tumblers provided within the housing to drivingly connect the rotary handles with the rotary latch bolts. A slidable latch-operator is provided near the inside handle for movement between a locked position wherein it prevents rotation of the outer tumbler to disable the outside handle from operating either of the bolts, and an unlocked position wherein it permits the outside handle to operate the latch bolts. A latch-operator override mechanism is provided for moving the latch-operator to its unlocked position when the inside handle is operated at a time when the latch-operator is in its locked position. The lock housing is formed from a pair of stamped metal plates which are interconnected both by spot welds and by a plurality of tabs which project from one of the plates and extend into interfitting engagement within recess formations provided on the other of the plates. Portions of the recess formations are utilized to position the spring properly between portions of the latch bolts, and to guide the movement of the latch operator between its locked and unlocked positions. The handles have independently rotatable shafts which extend along a common axis. The tumblers and the lock bolts also rotate about the common axis and cooperate to provide a rugged, tamper-resistant assembly.

10 Claims, 18 Drawing Figures

HANDLE-OPERATED DOOR LOCK WITH LATCH-OPERATOR OVERRIDE

CROSS-REFERENCE TO RELATED APPLICATION AND RELEVANT PATENT

Reference is made to the following application, of which the present case is a continuation-in-part, and to the following patent which is relevant to the subject matter of the present case:

HANDLE-OPERATED DOOR LOCK WITH LATCH-OPERATOR OVERRIDE, Ser. No. 182,690, filed Aug. 29, 1980, now abandoned in favor of the present case; and, DETENT SYSTEM FOR RELEASABLY RETAINING RELATIVELY MOVABLE MEMBERS IN PREDETERMINED POSITIONS, U.S. Pat. No. 4,126,340 issued Nov. 21, 1978, hereinafter referred to as the "Detent System Patent."

BACKGROUND OF THE INVENTION

1. Field of the Invention

The present invention relates to a novel and improved lock for sliding doors. The lock has inside and outside rotary handles for unlocking the lock, hook-shaped rotary latch bolts which extend from opposite sides of its housing for selectively engaging spaced strikes to selectively retain a sliding door in closed or open positions, a slidably movable latch-operator for selectively unlocking and locking the outside handle to enable and disable it from rotating the bolts, and a latch-operator override mechanism which moves the latch-operator to its unlocked position when the inside handle is operated at a time when the latch-operator is in its locked position. More particularly, the present invention relates to improvements in locks of the type described which result in the provision of a very compact, nested arrangement of operating components that move relative to each other by rotating about a common axis, and which cooperate to provide a rugged, tamper-resistant assembly.

2. Prior Art

A handle-operated door lock having inside and outside handles, and having a latch-operator which is movable to selectively lock and unlock the outside handle is described in the referenced Detent System Patent. The lock described in the referenced Detent System Patent does not have a latch-operator override feature; accordingly, when it is necessary to unlock the lock described in the referenced patent, the latch-operator must be moved out of its locked position before either of the inside or outside handles can be moved to unlock the lock.

While locks having inside handle latch-operator-override capabilities are known, previous lock proposals incorporating such features are not applicable to sliding door locks which have independently-operable, hook-shaped latch bolts that are arranged to pivot about a common axis together with interior and exterior handles and operating tumblers, wherein each of the bolts may be selectively operated by either of the handles.

SUMMARY OF THE INVENTION

The present invention overcomes the foregoing and other drawbacks of prior proposals by providing a novel and improved, compact, rigid, and tamper-resistant, rotary-handle-operated door lock for sliding doors with the lock incorporating an inside handle latch-operator override feature.

In accordance with the preferred practice of the present invention, a lock for sliding doors includes a structure defining a lock housing, a hook-shaped rotary latch bolts projecting from opposite sides of the housing for selectively engaging spaced strikes to enable the lock to selectively retain a sliding door in open and closed positions. A pair of handles have operating shafts which extend into the housing through aligned holes formed through front and rear sides of the housing. One of the handles is intended for installation on the outside of a sliding door. The other is intended to be accessible from inside the door. A spacer formed from plastics material is interposed between the inner ends of the shafts to assist in maintaining their alignment along a common axis, and to positively prevent the shafts from drivingly engaging each other.

A slidably-movable latch-operator is located near the inside handle. The latch-operator is movable between a locked position wherein it serves to prevent the outside handle from moving either of the bolts, and an unlocked position wherein it permits the outside handle to operate either of the bolts. A latch-operator override mechanism is associated with the inside handle and permits the inside handle to move the latch-operator to its unlocked position when the inside handle is operated. A detent assembly is provided to assist in releasably retaining the latch-operator in its locked and unlocked positions.

The lock housing is formed from a pair of stamped metal plates. One of the plates has a pair of opposed side walls which define opposite sides of a chamber located between the plates. Each of the side walls carries at least one tab-like projection extending therefrom. The other of the plates has recess formations configured to receive the tab-like projections in interfitting engagement. The tab-like projections are bent, i.e., folded-over, into interfitting engagement with the recess formations during assembly of the housing, and overlying portions of the plates are preferably spot-welded together. By this arrangement, the housing plates are prevented from moving relative to each other and the housing defines a strong-walled chamber for enclosing operating components of the lock.

A further feature of the recess formations is that they form projections which extend into the chamber defined by the housing and serve (1) to guide the movement of the latch operator between its locked and unlocked positions, and (2) to maintain proper positioning of a spring which biases the rotary latch bolts toward their latched positions.

As will be apparent from the foregoing summary, a feature of the present invention lies in the provision of a novel and improved, compact, rugged and tamper-resistant, rotary-handle-operated lock for sliding doors, with the lock incorporating an inside handle latch-operator-override feature, and with all of the rotary-operating functions of the lock's components being carried out by movements about a single, common axis.

BRIEF DESCRIPTION OF THE DRAWINGS

Other objects and a fuller understanding of the invention may be had by referring to the following description and claims taken in conjunction with the accompanying drawings, wherein:

DESCRIPTION OF THE PREFERRED EMBODIMENT

Figure 1:
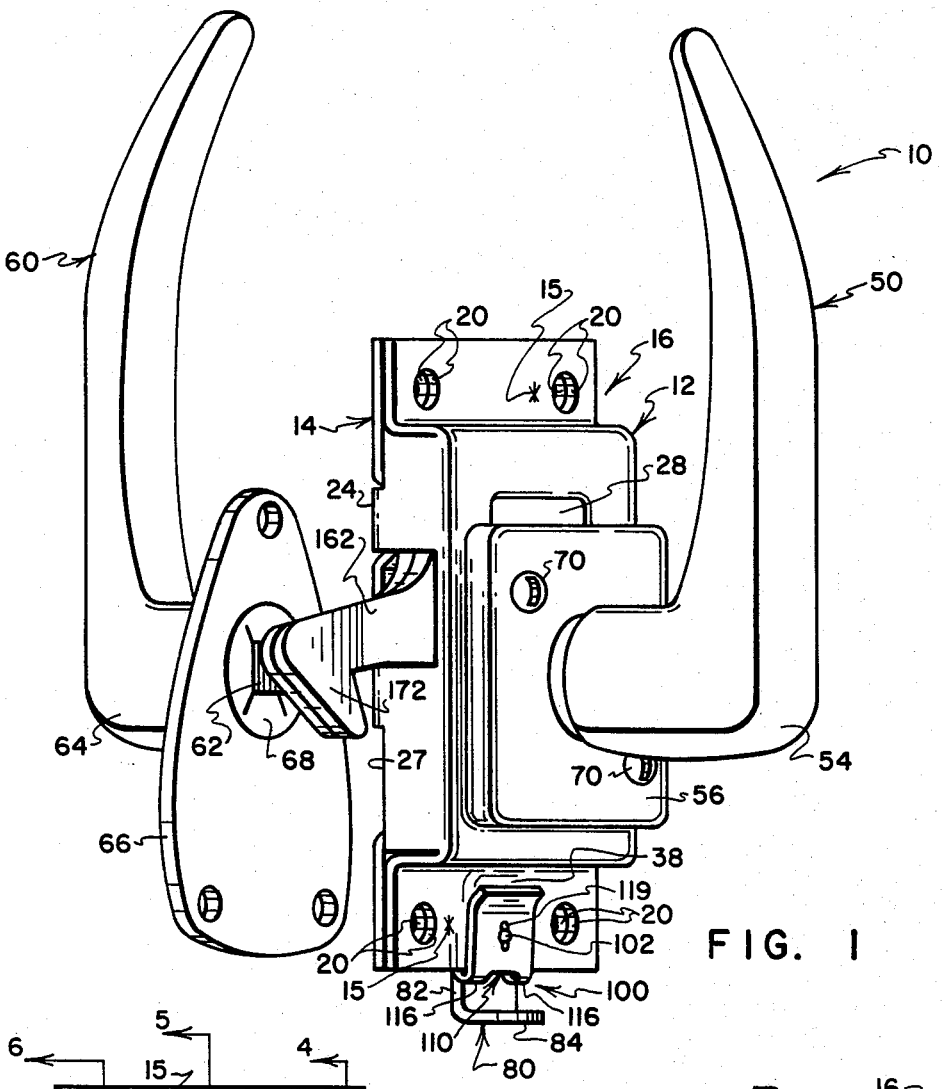
FIG. 1 is a perspective view of a handle-operated lock embodying the preferred practice of the present invention.
Figure 2:
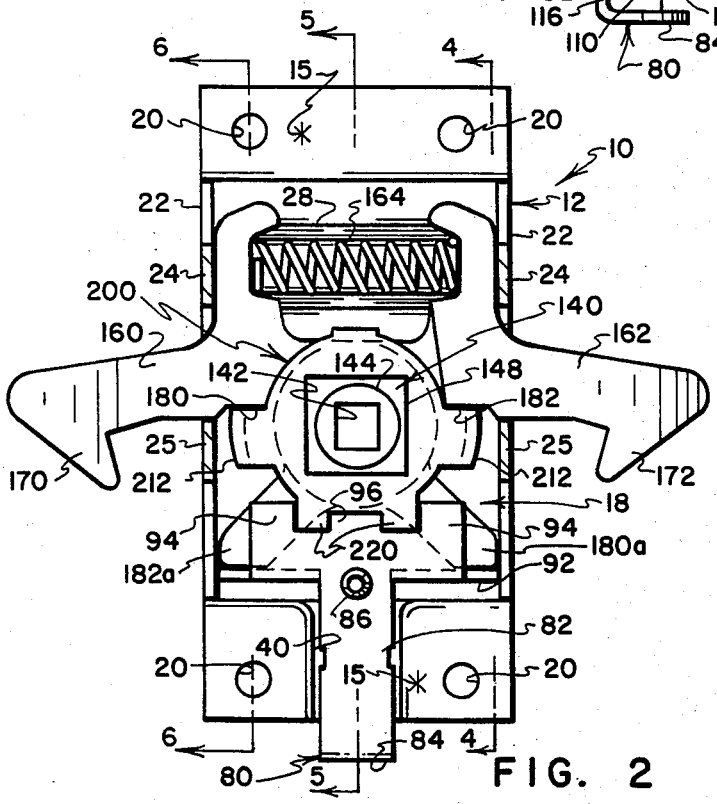
FIG. 2 is a rear elevational view of the lock assembly of FIG. 1 with both handles removed and with the back plate of the housing removed to permit components normally hidden from view by the back plate to be seen.
Figure 3:
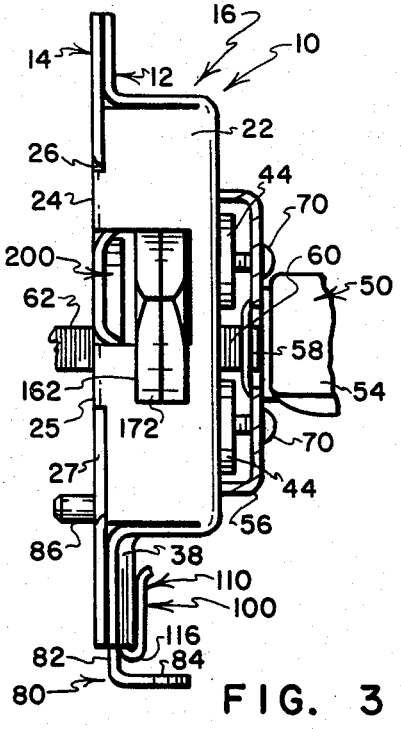
FIG. 3 is a side elevational view of the lock assembly of FIG. 1, with portions of the handles broken away.

Referring to FIGS. 1-3, a rotary-handle-operated door lock embodying the preferred practice of the present invention is indicated generally by the numeral 10. The lock 10 has a housing assembly 16 formed from stamped front and back plates 12, 14 which cooperate to define a chamber 18 between central portions of the plates 12, 14. Aligned mounting holes 20 are provided in opposite end portions of the plates 12, 14 to receive suitable fasteners (not shown) for mounting the housing assembly 16 on the inside of a sliding door or other suitable closure member (not shown). A pair of identical, hook-shaped, rotary bolt members 160, 162 project from opposite sides of the housing assembly 16 for engagement with suitable strikes (not shown) to retain a sliding door or other closure member on which the lock assembly 10 is mounted in open or closed positions. A spring 164 is housed within the chamber 18 and operates on both of the bolts 160, 162 to bias the bolts toward latched positions which are shown in FIGS. 1-3.

A brief overview of the characteristics of the lock 10 will assist in understanding the more detailed description which follows. Inner and outer rotary handles, indicated generally by the numerals 50, 52, have axially-aligned shafts 60, 62 of square cross-section which project into the chamber 18. The shafts 60, 62 are connected (by an assembly of components which are housed with the chamber 18, the components of this assembly being illustrated in FIG. 18) to the bolt members 160, 162 for rotating the bolt members 160, 162 about the common axis of the shafts 60, 62. A slidable latch-operator 80 is supported by the housing assembly 16 for movement between a retracted, locked position shown in FIGS. 1-3, and an extended, unlocked position shown in FIGS. 8-11. A detent assembly 100 of the general type described in the referenced Detent System Patent is interposed between the housing assembly 16 and the latch-operator 80 to selectively releasably retain the latch-operator 80 in its locked and unlocked positions.

Figure 8:
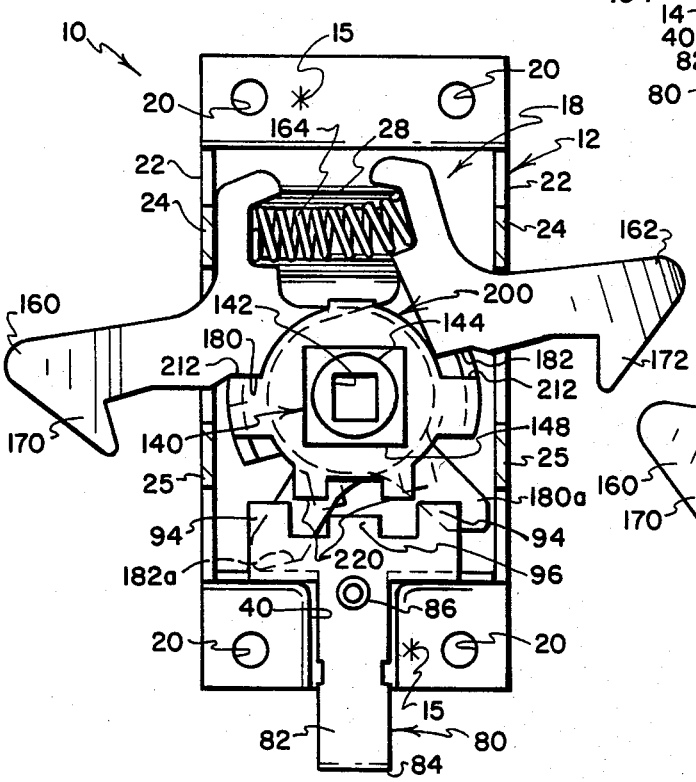
FIGS. 8 and 9 are views similar to FIG. 2 illustrating how components of the lock assembly move in response to operation of the inside handle in either of its directions of rotation.
Figure 9:
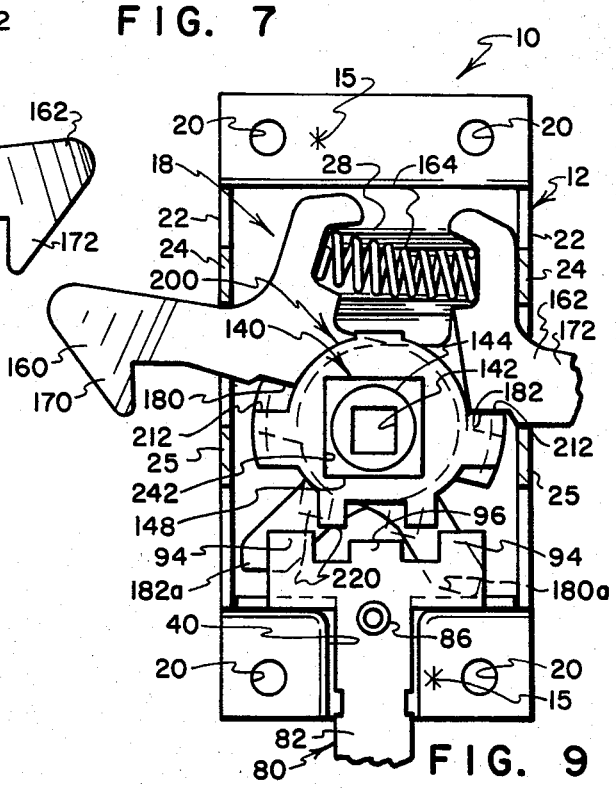

In operation, the lock 10 performs differently when the latch-operator 80 is in its retracted, locked position than when it is in its extended, unlocked position. When the latch-operator 80 is retracted to its locked position, the outside handle 52 is prevented from rotating, but the inside handle 50 remains operative to rotate (i.e., unlatch) either of the bolt members 160, 162. If the inside handle 50 is rotated clockwise (in relation to the position shown in FIG. 1), it will cause the bolt member 162 to rotate to its unlatching position, as is illustrated in FIG. 8. If the inside handle 50 is rotated counterclockwise (in relation to the position shown in FIG. 1), it will cause the bolt member 160 to rotate to its unlatching position, as is illustrated in FIG. 9. Rotation of the inside handle 50 in either of these directions will cause unlocking movement of the latch-operator 80.

Figure 10:
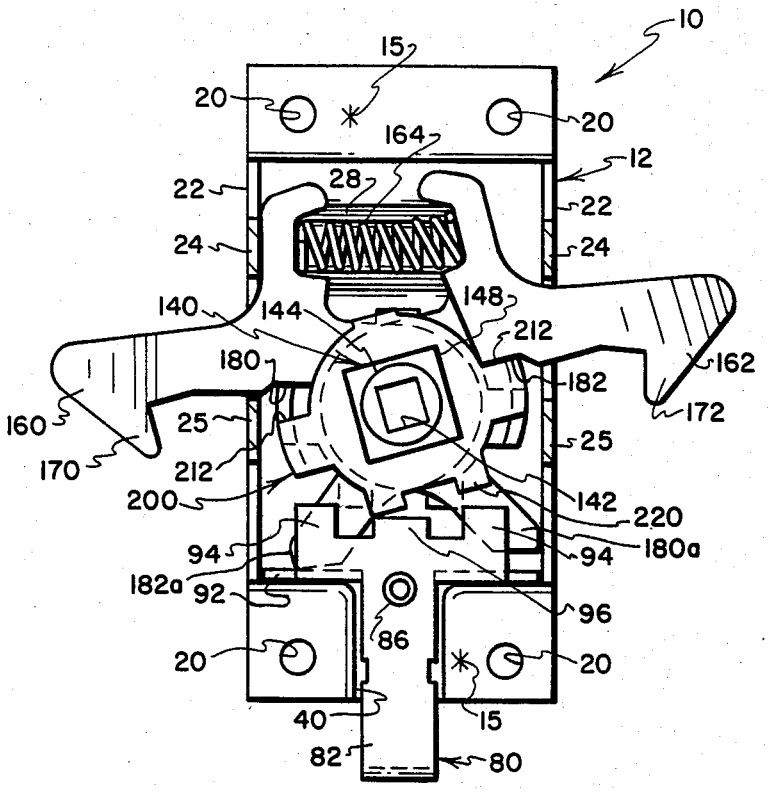
FIGS. 10 and 11 are views similar to FIG. 2 illustrating how components of the lock assembly move in response to operation of the outside handle in either of its directions of rotation.
Figure 11:
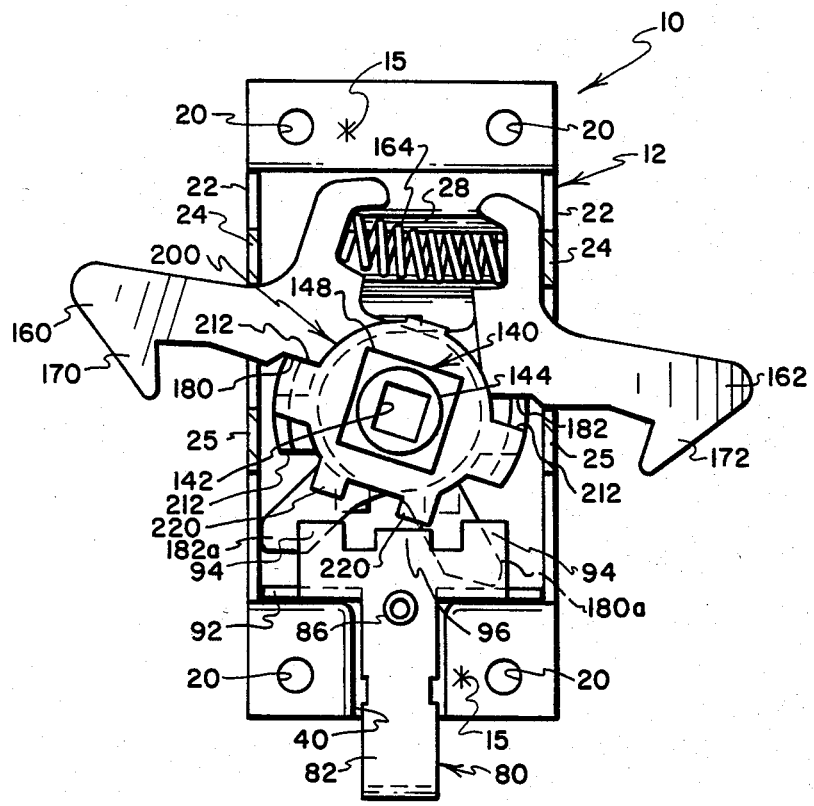

When the latch-operator 80 is extended to its unlocked position, either of the inside or outside handles 50, 52 may be rotated to unlatch either of the bolt members 160, 162. The inner handle 50 will operate as described above to move one or the other of the bolt members 160, 162, depending on the direction in which it is rotated. The outer handle 52, if rotated clockwise (in relation to the position shown in FIG. 1), will cause the bolt member 162 to rotate to its unlatching position, as is illustrated in FIG. 10. If the outside handle 52 is rotated counterclockwise (in relation to the position shown in FIG. 1), it will cause the bolt member 160 to rotate to its unlatching position, as is illustrated in FIG. 11.

Figure 12:
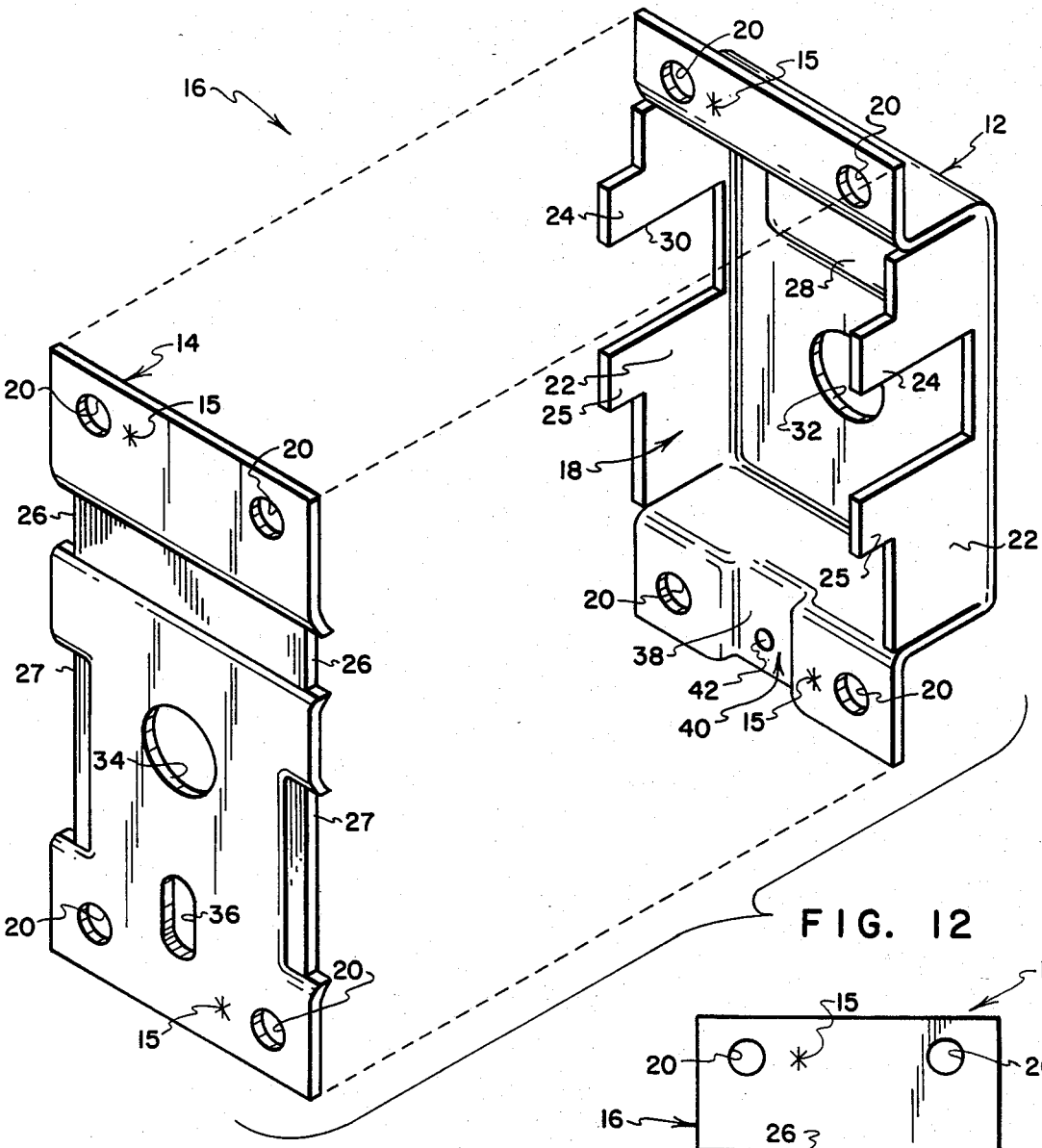
FIG. 12 is an exploded perspective view of components of the lock's housing.
Figure 13:
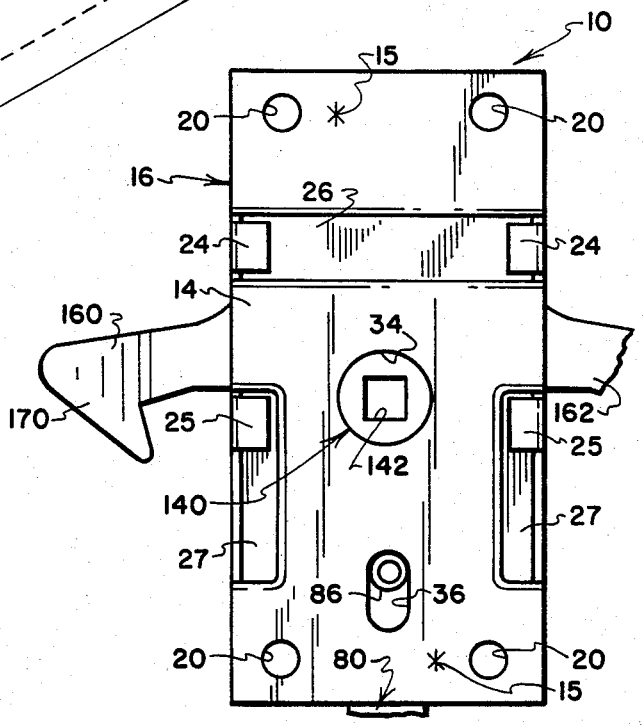
FIG. 13 is a rear elevational view of the lock assembly of FIG. 1 with the back plate of the housing in place.

Referring to FIGS. 12 and 13, the housing assembly front plate 12 is formed as a metal stamping having opposed side walls 2 which define opposite sides of the chamber 18. The side walls 22 have tab-like projections 24, 25 formed integrally therewith. The tabs 24, 25 extend in the same planes as their associated side walls 22 when the front plate 12 is formed, as is shown in FIG. 12, but are bent, i.e., folded-over, to overlie portions of the back plate 14 when the housing 16 is assembled, as is shown in FIG. 13.

The back plate 14 has a plurality of recess-like formations 26, 27 which are configured to receive the tab-like projections 24, 25 when the tabs 24, 25 are bent into place during assembly of the housing 16. The formations 26, 27 receive the tabs 24, 25 in interfitting engagement, whereby a rigid, strong housing assembly 16 is provided. The formations 26, 27 also serve to enhance the rigidity and strength of the otherwise substantially planar back plate 14. Inasmuch as the components which are housed within the chamber 18 exert forces on the plates 12, 14 during operation of the lock 10, tending to force the plates 12, 14 apart, the use of the tabs 24, 25 crimped into the receiving formations 26, 27 has been found to provide a simple and inexpensive, yet highly effective, means of rigidifying and strongly interconnecting the housing assembly plates 12, 14. Additionally, spot welds are preferably used to further enhance the rigid interconnection of the plates 12, 14. The spot welds are provided on overlying portions of the plates 12, 14 at locations indicated by asterisks 15 in FIGS. 1, 2, 8, 9, 10, 11, 12 and 13.

Figure 5:
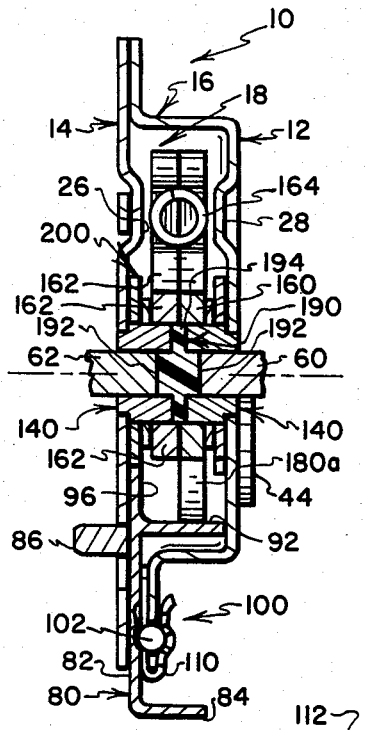
Figure 6:
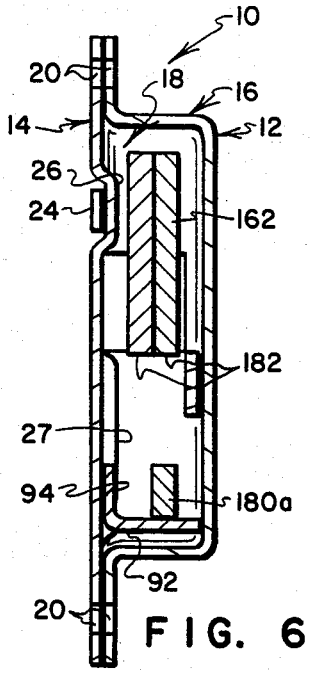

The front plate 12 has an elongate formation 28 which projects into the chamber 18. The formation 28 projects toward the back plate formation 26, as is best seen in FIG. 5, and these two formations 26, 28 serve to narrow the chamber 18 in an area along opposite sides of the spring 164, thereby assisting to retain the spring 164 in place.

The back plate formations 27 extend along opposite sides of the slide path of travel of the latch-operator 80, as will be described, and perform the added function of assisting to guide the latch-operator 80 in moving between its locked and unlocked positions.

Figure 4:
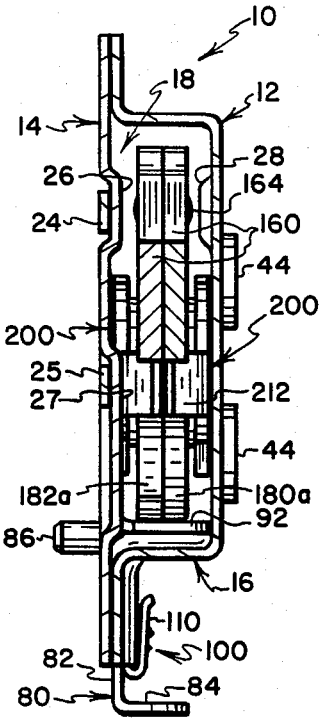
FIGS. 4, 5 and 6 are sectional views as seen from planes indicated by lines 4—4, 5—5, and 6—6 in FIG. 2.
Figure 7:
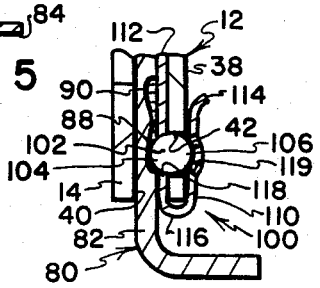
FIG. 7 is an enlargement of a portion of the sectional view of FIG. 5.

The plates 12, 14 have aligned holes 32, 34 through which the handle shafts 60, 62 extend. The back plate 14 has an elongate slot 36 which opens into the chamber 18. The front plate 12 has a channel-shaped part 38 which cooperates with the back plate 14 to define a passage 40 within which the latch-operator 80 is slidably supported. A hole 42 is formed through the front plate part 38, as is best seen in FIGS. 7 and 12. A pair of threaded weld nuts 44 are welded onto the front plate 12 at locations on opposite sides of the hole 32, as is best seen in FIGS. 3 and 4.

Figure 14:
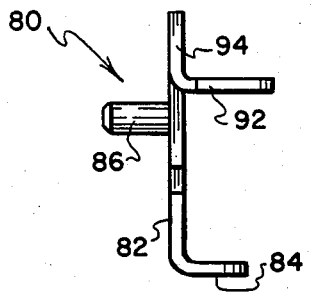
FIG. 14 is an end elevational view of a latch-operator utilized in the lock of FIG. 1.
Figure 15:
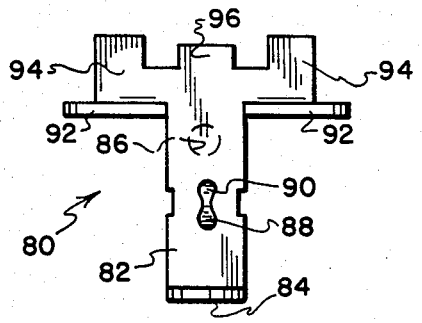
FIG. 15 is a side elevational view of the latch-operator of FIG. 14.
Figure 18:
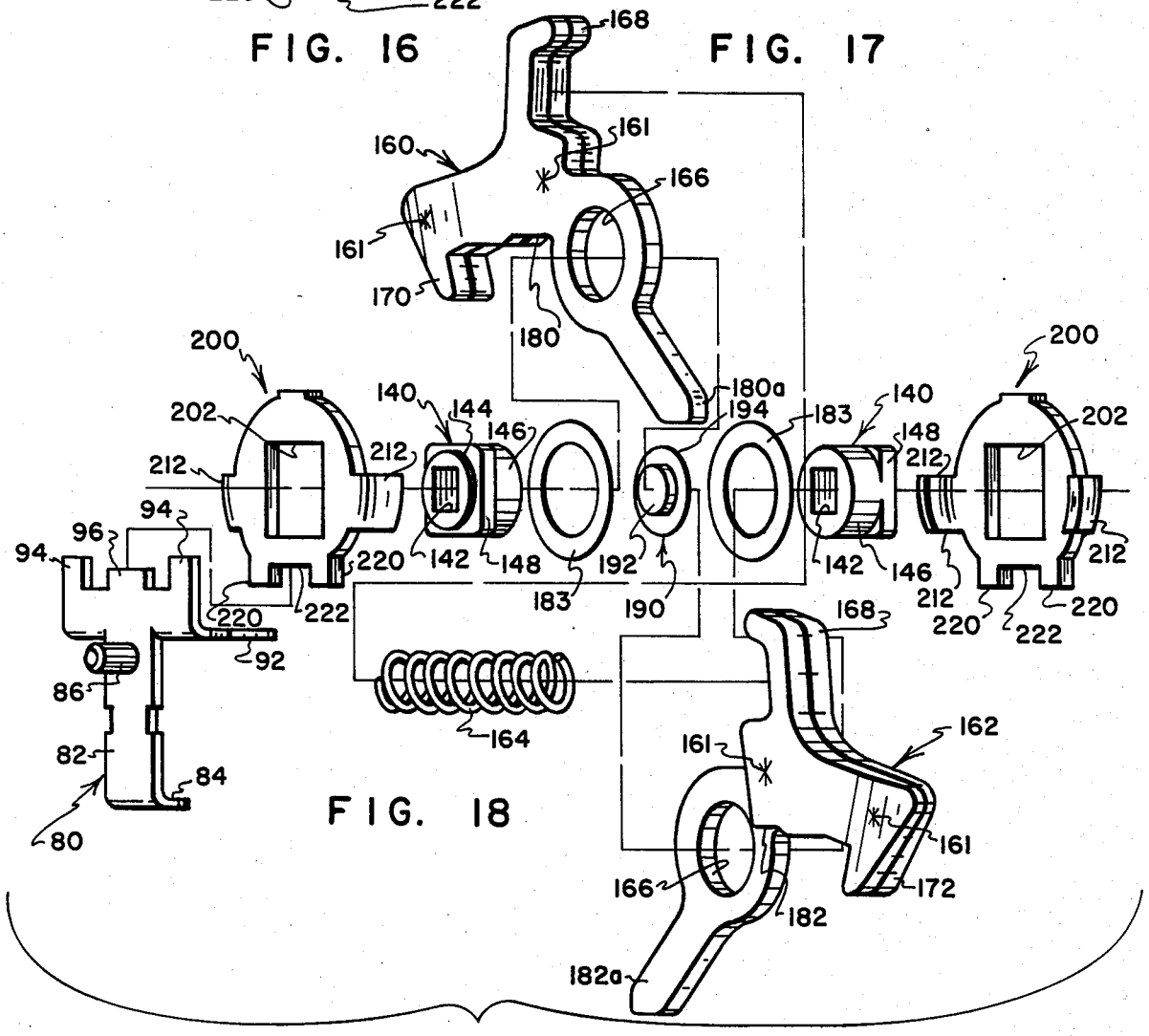
FIG. 18 is an exploded perspective view of selected operating components of the lock.

Referring to FIGS. 14, 15 and 18, the latch-operator 80 has an elongate, flat central stem 82 with an L-shaped lower end region 84. A cylindrical connection pin 86 is rigidly secured to the central stem 82 to permit the latch-operator 80 to be coupled to a conventional key-cylinder linkage or the like (not shown) for enabling the latch-operator 80 to be remotely moved (as from outside a door on which the lock 10 may be mounted). The pin 86 extends through the slot 36 formed in the back plate 14. A pair of ramp-like recesses 88, 90 of generally tear-drop-shape are formed in one face of the stem 82 at closely spaced locations along its length. The ramp-like character of the recesses 88, 90 is best illustrated in the enlarged sectional view of FIG. 7 wherein it is seen that the deepest portions of the recesses 88, 90 are located adjacent the widest parts of the recesses 88, 90.

The upper end of the latch-operator 80 includes tooth-like stop projections 94, 96, and carries horizontally-extending leg portions 92. As will be explained in greater detail, the horizontally-extending leg portions 92 may be engaged by unlocking arms 180*a*, 182*a* carried on the bolts 160, 162 to move the latch-operator 80 from its locked position, shown in FIGS. 1–3 and 7, to its unlocked position, shown in FIGS. 8–11. Opposed sides of the teeth 94 extend along and are guided by the projecting formations 27 formed in the back plate 14, whereby the back plate formations 27 serve to assist in guiding the movement of the latch-operator 80 between its locked and unlocked positions.

Referring to FIG. 7, the detent assembly 100 is of the general type described in the referenced Detent System Patent. The tear-drop-shaped detent recesses 88, 90 formed in the latch-operator stem 82 are smaller in size than is the hole 42 formed through the front plate part 38. When the latch-operator 80 is in its retracted or locked position, as shown in FIGS. 1–3 and 7, the detent recess 88 aligns with the hole 42. When the latch-operator 80 is in its extended or unlocked position, as shown in FIGS. 8–11, the detent recess 90 aligns with the hole 42. The ramp-like, tear-drop-shaped configuration of the recesses 88, 90 facilitates movement of a detent element 102 from within one of the recesses 88, 90 to within the other of the recesses 88, 90.

A detent element, here taking the form of a hardened steel ball 102, is loosely positioned in the hole 42 for movement toward and away from the stem 82 of the latch-operator 80. The ball 102 has a tip portion 104 which projects from the hole 42 toward the stem 82, and a spring engagement portion 106 which projects from the opposite end of the hole 42. When the latch-operator 80 is in its retracted, locked position, the projecting tip portion 104 of the ball 102 is received in the tear-shaped recess 88. When the latch-operator 80 is in its extended, unlocked position, the projecting tip portion 104 is received in the tear-shaped recess 90.

A U-shaped spring clip 110 is carried on the front plate part 38. The spring clip 110 has an inner leg 112 which extends along the one side surface of the front plate part 38, and an outer leg 114 which extends along the opposite side surface. The legs 112, 114 are interconnected by a pair of spaced, curved bottom portions 116. A hole 118 is formed through the inner leg 112 in alignment with the hole 42 and has a diameter sufficient to let the ball 102 pass therethrough. An opening 119 is formed in the outer leg 114 for receiving the spring-engaging portion 106 of the ball 102.

The ball 102 not only serves the function of a detent element to selectively retain the latch-operator 80 in its locked and unlocked positions, but also serves to hold the spring clip 110 in place on the front plate part 38. As will be apparent, since the tip 104 of the ball 102 projects through the hole 118 formed in the inner leg 112 of the spring clip 110, the ball 102 operates to help retain the spring clip 110 in place on the front plate part 38. The engagement between the opening 119 and the ball portion 106 also helps to retain the spring clip 110 in position on the front plate part 38. Accordingly, the hole 118 and the opening 119 can be thought of as formations which cooperate with the ball 102 to help retain the spring clip 110 in place on the front plate part 38.

Referring to FIGS. 1 and 3, the inner handle 50 is of L-shaped configuration, having a lower end region 54 which rigidly connects with the shaft 60. An escutcheon plate 56 is carried on the shaft 60 at a location adjacent the junction of the lower end region 54 and the shaft 60. A spring steel retainer washer 58 holds the escutcheon plate 56 in position adjacent the end region 54. A pair of screws 70 extend through holes found in the escutcheon plate 56 and are threaded into the weld nuts 44 carried on the front housing plate 12.

Referring to FIG. 1, the outer handle 52 is of L-shaped configuration, having a lower end region 64 which rigidly connects with the shaft 62. An escutcheon plate 66 is carried on the shaft 62 at a location adjacent the juncture of the lower end region 64 and the shaft 62. A spring steel retainer washer 68 holds the escutcheon plate 66 in position adjacent the end region 64. Suitable screws, not shown, may be used to secure the escutcheon plate 66 on the outer surface of a sliding door (not shown) or other structure on which the housing assembly 16 is mounted.

Referring to FIGS. 5 and 18, inner and outer hub members 140 are interposed between the handle shafts 60, 62 and the housing plates 12, 14. The hubs 140 are of identical configuration, each having a square hole 142 formed therethrough to receive one of the shafts 60, 62. The hubs 140 have complexly configured outer surfaces including end portions 144, 146 of circular cross-section, and central portions 148 of square cross section. The end portions 144 are journaled in the housing plate holes 32, 34.

The bolts 160, 162 are identical one with another. Each of the bolts 160, 162 comprises a welded assembly of two parts, with weld point locations indicated generally by asterisks 161 in FIG. 18, and with one of the parts defining a central mounting hole 166 which is journaled on the cylindrical surface portions 146 of a separate one of the hubs 140. Each of the bolts 160, 162 has an upstanding arm 168 which is engaged by a separate end of the spring 164 and which is biased by the spring 164 toward a latched position engaging one of the housing side walls 22, as is illustrated in FIG. 2. The bolt 160 has a hook-shaped arm 170 which, in the vicinity of the hole 166, defines an abutment surface 180. The bolt 162 has a hook-shaped arm 172 which, in the vicinity of the hole 166, defines an abutment surface 182. The bolts 160, 162 have downwardly-projecting unlocking arms 180*a*, 182*a*. The unlocking arms 180*a*, 182*a* are engageable with the horizontally-extending leg portions 92 of the latch-operator 80 to slidably move the latch-operator 80 from its locked position to its unlocked position whenever one of the bolts 160, 162 is rotated to its unlatched position at a time when the latch-operator 80 is in its locked position.

Referring to FIGS. 5 and 18, a spacer 190 formed of plastics material is interposed between the hubs 140. The spacer 190 has a complexly configured outer surface including end portions 192 of relatively small diameter, and a central portion 194 of relatively larger diameter. The small diameter end portions 192 are configured to be received within separate ones of the hub holes 142. The relatively larger diameter central portion serves to separate the hubs 140. A feature of the spacer 190 is that it helps to maintain component alignment for rotation about a common axis, and yet prevents the shafts 160, 162 from engaging each other, or from extending into each other's associated hub 140, thereby positively preventing the establishment of a driving interconnection between the handles 50, 52.

Referring to FIG. 18, a pair of thin metal washers 183 are carried on the cylindrical surfaces 146 of the hubs 140 at locations adjacent the transitions between the cylindrical and square surface portions 146, 148. The washers 183 serve to space the bolts 160, 162 from a pair of tumbler members 200 which are carried on the hubs 140.

Figure 16:
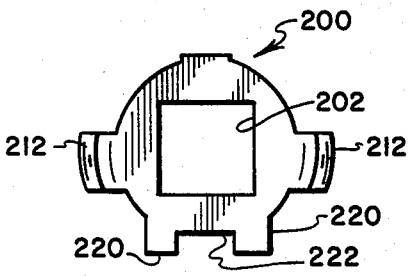
FIG. 16 is a side elevational view of one of two identical tumblers utilized in the lock of FIG. 1.
Figure 17:
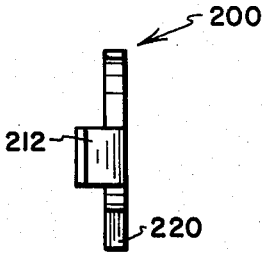
FIG. 17 is an end elevational view of the tumbler of FIG. 16.

Referring to FIGS. 16–18 in conjunction with FIGS. 4–11, identical inner and outer tumbler members 200 are carried on the hubs 140. Each of the tumblers 200 has a square mounting hole 202 that is drivingly connected to one of the handles 50, 52 for rotation therewith by virtue of its square hole 202 being in driving engagement with the square surface 148 on one of the hubs 140, which, in turn, is carried on one of the handle shafts 60, 62.

Each of the tumbler 200 carries a pair of spaced projections 210, 212 which normally engage the bolt abutment surfaces 180, 182. By this arrangement, when either of the handles 50, 52 is rotated the engagement between one or the other of the projections 210, 212 and the abutment surfaces 180, 182 will cause one or the other of the bolts 160, 162 to rotate to its unlatched position. The bolt which is rotated depends on the direction in which the handle being rotated is turned. Rotation of the inner handle 50 in a clockwise direction, as viewed in FIG. 1, will bring the projection 212 of the associated inner handle tumbler 200 into engagement with the abutment surface 182, thereby causing the bolt 162 to rotate to its unlatched position, as is illustrated in FIG. 10. Similarly, when the inner handle 50 is rotated counterclockwise, as viewed in FIG. 1, the engagement between the projection 210 and the abutment 180 will cause the bolt 160 to rotate to its unlatched position, as viewed in FIG. 11.

While each of the tumblers 200 is provided with a pair of tooth formations 220 separated by a recess 222, only the tooth and recess formations 220, 222 of the outer tumbler 200 (the tumbler 200 associated with the outer handle 60) are utilized to effect locking of the lock 10. The tooth and recess formations 220, 222 of the outer tumbler 200 are configured to interfit with the tooth formations 94, 96 on the latch-operator 80. When the latch-operator 80 is in its retracted, locked position, as shown in FIGS. 1–3, the tooth and recess formations 220, 222 of the outer tumbler 200 are interengaged with the tooth formations 94, 96 to prevent rotation of the outer handle 60.

When the inside handle 50 is rotated either clockwise or counterclockwise to move the bolts 160, 162 (and assuming the latch-operator 80 is in its locked position when this takes place), one or the other of the unlocking arms 180*a*, 182*a* on the bolts 160, 162 will engage one of the horizontal leg portions 92 on the latch-operator 80 and will force the latch-operator 80 to slide from its locked position to its unlocked position. Similarly, if either of the bolts 160, 162 is rotated by slamming it into engagement with a strike (not shown), the same type of bolt-rotating action will cause the latch-operator 80 to assume its unlocked position.

As will be apparent from the foregoing description, the present invention provides a novel and improved handle-operated door lock having a pair of bolts which are selectively operable by inside or outside handles, whereby the lock may be used advantageously on a sliding door to selectively releasably retain the door in its open or closed position. While a latch-operator is provided for "locking" the outer handle to prevent its operating either of the bolts, the inside handle is always capable of operating either of the bolts. Moreover, in the event the inside handle is operated while the latch-operator is in its locked position, a latch-operator override will cause the latch-operator to be moved to its unlocked position, thereby freeing the outside handle for use.

Particularly advantageous features of the described lock lie in the use of tabs and interfitting receiving formations providing on the housing plates to facilitate the formation of a strong and rigid housing assembly, and the provision of a compact array of overlying rotary operating components, all of which rotate about a common axis, and which cooperate to form a sturdy, tamper-resistant lock.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. Neither the orientation of the lock 10, as depicted in the drawings and as described in the text herewith, nor the use of such orientation terminology as "upward", "downward," "left," "right," and the like are to be construed as in any way limiting the scope of the invention or the applications in which its principles may be employed. It is intended that the patent shall cover, by suitable expression in the appended claims, whatever features of patentable novelty exist in the invention disclosed.

What is claimed is:

1. A handle-operated door lock, comprising:

(a) a housing structure having front and rear faces connected by opposed sides, with the front and rear faces each having an opening formed therethrough, and with the openings being aligned along a common axis;

(b) a pair of hook-shaped rotary latch bolts each projecting from a separate one of the opposed sides of the housing structure;

(c) inner and outer rotary handles each located near a separate one of the front and rear faces of the housing structure and each having a shaft portion that extends through an associated one of the openings and along the common axis;

(d) connection means carried within the housing structure and extending along the common axis for coupling the shaft portions of the rotary handles with the rotary latch bolts, and for cooperating with the housing structure for mounting the shaft portions of the handles for rotation about the common axis such that either of the handles may be rotated about the common axis independently of the other handle to selectively rotate either of the bolts from latched to unlatched positions;

(e) biasing means carried within the housing for biasing the rotary latch bolts toward their latched positions;

(f) latch operator means supported by the housing structure for sliding movement toward and away from the common axis between a locked position wherein the latch operator means functions to prevent the outer handle form rotating either of the bolts, and an unlocked position wherein the latch operator means does not interfere with rotation of either of the handles or with rotation of either of the bolts about the common axis;

(g) latch-operator override means connected to the housing and being movably mounted relative to the housing for moving the latch operator means to its unlocked position in response to rotation of the inner handle so that the latch-operator override means assures that the latch operator means cannot prevent inner handle rotation about the common axis, and the inner handle can, at all times, be operated to rotate either of the bolts about the common axis from its latched position to its unlatched position;

(h) the housing structure including a pair of metal plates, one of the plates having opposed side walls defining opposite sides of a chamber located between the plates, the side walls each having at least one tab-like projection extending therefrom, the other of the plates having formations configured to receive the tab-like projections in interfitting engagement, the tab-like projections being bent into interfitting engagement with the formations during assembly of the housing structure;

(i) the connection means including a pair of rotary tumblers journaled within the housing structure for rotation about the common axis, each of the tumblers being drivingly connected to a separate one of the inner and outer rotary handles; and, (j) the latch-operator means being engageable with at least one of the rotary tumblers when the latch operator is in its locked position.

2. The handle-operated door lock of claim 1 wherein the connection means additionally includes spacer means interposed between the shaft portions at a location along the common axis for positively preventing the shaft portions from drivingly engaging each other.

3. The handle-operated lock of claim 1 wherein the formations configured to receive the tab-like projections define projecting parts which extend inwardly into the chamber defined by the housing structure.

4. The handle-operated lock of claim 3 wherein portions of the projecting parts assist in guiding the movement of the latch-operator toward and away from the common axis between the locked and unlocked positions of the latch-operator.

5. The handle-operated lock of claim 3 wherein:

(a) the biasing means includes a compression coil spring; and, (b) portions of the projecting parts serve to position the spring within the housing structure between spaced portions of the rotary bolts.

6. A handle-operated door lock, comprising:

(a) a housing structure having front and rear faces with the front and rear faces having openings formed therethrough that align along a common axis;

(b) a pair of hook-shaped rotary latch bolts projecting from opposite sides of the housing structure;

(c) inner and outer rotary handles located on opposed front and rear sides of the housing structure, and each of the handles having a shaft portion that extends through an associated one of the openings and along the common axis;

(d) connection means carried within the housing structure and extending along the common axis for coupling the shaft portions of the rotary handles with the rotary latch bolts, and for cooperating with the housing structure for mounting the shaft portions of the handles for rotation about the common axis such that either of the handles may be rotated about the common axis independently of the other handle to selectively rotate either of the bolts from latched to unlatched position;

(e) biasing means carried within the housing for biasing the rotary latch bolts toward their latched positions;

(f) latch operator means supported by the housing structure for sliding movement toward and away from the common axis between a locked position wherein the latch operator means functions to prevent the outer handle from rotating either of the bolts, and an unlocked position wherein the latch operator means does not interfere with rotation of either of the handles or with rotation of either of the bolts about the common axis;

(g) latch-operator override means connected to the housing and being movably mounted relative to the housing for moving the latch operator means to its unlocked position in response to rotation of the inner handle, whereby the latch-operator override means assures that the latch operator means cannot prevent inner handle rotation about the common axis, and the inner handle can, at all times, be operated to rotate either of the bolts about the common axis;

(h) the housing structure including a pair of metal plates, one of the plates having opposed side walls defining opposite sides of a chamber located between the plates, the side walls each having at least one tab-like projection extending therefrom, the other of the plates having formations configured to receive the tab-like projections in interfitting engagement, the tab-like projections being bent into interfitting engagement with the formations during assembly of the housing structure;

(i) the connection means including:

(i) an inner handle tumbler housed within the chamber and drivingly connected to the inner handle shaft for rotation therewith about the common axis; and, (ii) an outer handle tumbler housed within the chamber and drivingly connected to the outer handle shaft for rotation therewith about the common axis;

(j) each of the tumblers carrying a pair of formations which are selectively engageable with the bolts for rotating one or the other of the bolts about the common axis in response to rotation in one direction or the other of its associated handle about the common axis;

(k) the latch-operated means including structure engageable with the outer handle tumbler to prevent its rotation when the latch-operator means is in its locked position; and, (1) the latch-operator override means including cooperable engageable formations on the inner handle tumbler and the latch-operator means for moving the latch-operator means from its locked position to its unlocked position when the inner handle is rotated about the common axis to rotate either of the bolts out of its latched position.

7. The handle-operated door lock of claim 6 wherein the connection means additionally includes spacer means interposed between the shaft portions at a location along the common axis for positively preventing the shaft portions from drivingly engaging each other.

8. The handle-operated lock of claim 6 wherein the formations configured to receive the tab-like projections define projecting parts which extend inwardly into the chamber defined by the housing structure.

9. The handle-operated lock of claim 8 wherein portions of the projecting parts assist in guiding the movement of the latch-operator toward and away from the common axis between the locked and unlocked positions of the latch-operator.

10. The handle-operated lock of claim 8 wherein:

(a) the biasing means includes a compression coil spring; and, (b) portions of the projecting parts serve to position the spring within the housing structure between spaced portions of the rotary bolts.

* * * * *